US008699728B2

(12) United States Patent
Kasai et al.

(10) Patent No.: US 8,699,728 B2
(45) **Date of Patent: *Apr. 15, 2014**

(54) ACOUSTIC SENSOR

(75) Inventors: Takashi Kasai, Kusatsu (JP); Masaki Munechika, Kusatsu (JP); Toshiyuki Takahashi, Otsu (JP)

(73) Assignee: OMRON Corporation, Kyoto (JP)

( * ) Notice: Subject to any disclaimer, the term of this patent is extended or adjusted under 35 U.S.C. 154(b) by 579 days.

This patent is subject to a terminal disclaimer.

(21) Appl. No.: 12/663,123

(22) PCT Filed: Jan. 30, 2008

(86) PCT No.: PCT/JP2008/051399

§ 371 (c)(1),
(2), (4) Date: Mar. 20, 2012

(87) PCT Pub. No.: WO2008/149571

PCT Pub. Date: Dec. 11, 2008

(65) Prior Publication Data

US 2010/0176821 A1 Jul. 15, 2010

(51) Int. Cl.
*H04R 25/00* (2006.01)

(52) U.S. Cl.
USPC ..... 381/174; 381/173; 381/175; 381/190

(58) Field of Classification Search
USPC ..... 381/174, 173, 190, 175
See application file for complete search history.

(56) References Cited

U.S. PATENT DOCUMENTS

| | | | | |
|---|---|---|---|---|
| 2007/0154040 | A1* | 7/2007 | Chen | 381/174 |
| 2007/0261910 | A1* | 11/2007 | Kasai et al. | 181/142 |

FOREIGN PATENT DOCUMENTS

| | | | |
|---|---|---|---|
| JP | 8-111535 | A | 4/1996 |
| JP | 9-18021 | A | 1/1997 |
| JP | 2004-506394 | A | 2/2004 |
| JP | 2004-96543 | A | 3/2004 |
| JP | 2004-128957 | A | 4/2004 |
| JP | 2006-157863 | A | 6/2006 |
| JP | 2007-005913 | A | 1/2007 |
| WO | 02/15636 | A2 | 2/2002 |
| WO | 2006/049100 | A1 | 5/2006 |

OTHER PUBLICATIONS

International Search Report w/translation from PCT/JP2008/051399 dated Mar. 25, 2008 (4 pages).
Written Opinion w/translation from PCT/JP2008/051399 dated Mar. 25, 2008 (7 pages).

(Continued)

*Primary Examiner* — Davetta W Goins
*Assistant Examiner* — Amir Etesam
(74) *Attorney, Agent, or Firm* — Osha Liang LLP

(57) ABSTRACT

A vibrating electrode plate 24 that senses a sound pressure faces a counter electrode plate 25 to form a capacitance type acoustic sensor. Acoustic perforations are opened in the counter electrode plate 25 in order to allow vibration to pass through. The acoustic perforations opened in the counter electrode plate 25 include plural acoustic perforations 31 having a relatively small opening area and one acoustic perforation 36 having a relatively large opening area. The acoustic perforations 31 and 36 are disposed into a lattice shape at equal intervals. Assuming that L is a width of a diaphragm 28, in the counter electrode plate 25, the acoustic perforation 36 having the large opening area is provided within a circular region a having a radius r=L/4 around a position facing a center of the diaphragm 28.

6 Claims, 13 Drawing Sheets

(56) References Cited

OTHER PUBLICATIONS

Abstract of Japanese Publication No. 2004-128957 dated Apr. 22, 2004; Sumitomo Metal Industries, Ltd. (1 page).
Abstract of Japanese Publication No. 2006-157863 dated Jun. 15, 2006; Omron Corp. (1 page).
Abstract of Japanese Publication No. 2004-506394 dated Feb. 26, 2004; Knowles Electronics, L.L.C. (1 page).
Tsuchitani, et al.; "Measurement of the Surface Force in Micro Structures and Its Reduction"; Society of Instrument and Control Engineers' vol. 30, No. 2, pp. 136-142; 1994 (7 pages).
Japanese Office Action for Japanese Application No. 2007-148476, mailed on Feb. 7, 2012, and English translation thereof (4 pages).

* cited by examiner

ACOUSTIC SENSOR

TECHNICAL FIELD

The present invention relates to an acoustic sensor, particularly to an acoustic sensor that detects a sound pressure propagating through gas or liquid, that is, acoustic vibration.

BACKGROUND ART

Japanese Examined Patent Publication No. 2004-506394 (Patent Document 1) and Japanese Unexamined Patent Publication No. 2005-171763 (Patent Document 2) disclose acoustic sensors.

FIG. 1 is a plan view schematically illustrating a structure of a conventional acoustic sensor 11. In the acoustic sensor 11, a vibrating electrode plate 12 (movable electrode) and a counter electrode plate 13 (fixed electrode) face each other with a micro gap (air gap) interposed therebetween. The counter electrode plate 13 is exposed to the outside on a substrate, and the vibrating electrode plate 12 is covered with the counter electrode plate 13. In the counter electrode plate 13, plural acoustic perforations 14 (acoustic holes) are opened to have uniform opening areas and are disposed at equal intervals.

Because the vibrating electrode plate 12 is formed by a thin film, when a sound pressure (acoustic vibration) reaches the vibrating electrode plate 12 through the acoustic perforations 14 in the counter electrode plate 13, the vibrating electrode plate 12 vibrates microscopically in response to the vibration. A gap between the vibrating electrode plate 12 and the counter electrode plate 13 changes when the vibrating electrode plate 12 vibrates. Therefore, the acoustic vibration is detected by detecting a change in electrostatic capacitance between the vibrating electrode plate 12 and the counter electrode plate 13 with use of the acoustic sensor 11.

In the above acoustic sensor, the acoustic perforations are provided in the counter electrode plate, and the acoustic perforations have the following various functions in addition to the function of allowing the sound pressure to pass therethrough and vibrate the vibrating electrode plate:

(1) The sound pressure is released through the acoustic perforation such that the sound pressure is not applied to the counter electrode plate.

(2) Air in the micro gap is released through the acoustic perforation, thereby preventing air damping of the vibrating electrode plate.

(3) The acoustic perforation acts as an etching hole when the micro gap is prepared between the vibrating electrode plate and the counter electrode plate by utilizing the micromachining (semiconductor microfabrication) technique.

Patent Document 1: Japanese Examined Patent Publication No. 2004-506394

Patent Document 2: Japanese Unexamined Patent Publication No. 2005-171763

Patent Document 3: Japanese Unexamined Patent Publication No. 2004-128957

DISCLOSURE OF THE INVENTION

Problems to be Solved by the Invention (Problem in Inspection Process)

In an inspection process after production of the acoustic sensor, the acoustic sensor is desirably inspected by measuring the gap between the vibrating electrode plate and the counter electrode plate or the vibration characteristic of the vibrating electrode plate. However, in the acoustic sensor disclosed in Patent Document 1 or 2, because the vibrating electrode plate is covered with the counter electrode plate, the vibrating electrode plate cannot directly be inspected from the surface side. Moreover, because the micro gap between the vibrating electrode plate and the counter electrode plate is covered with the vibrating electrode plate on the rear surface side, the acoustic sensor cannot be inspected from the rear surface side.

Because the acoustic perforations are opened in the counter electrode plate, it is considered that the gap or the vibration characteristic of the vibrating electrode plate is measured through the acoustic perforations. However, in the acoustic sensor disclosed in Patent Document 1 or 2, the acoustic perforations having the uniform opening diameters are provided in the counter electrode plate, and the acoustic perforations are substantially equally arranged almost all over the counter electrode plate. Therefore, the opening diameter of the acoustic perforations cannot be increased, and the acoustic perforations usually have a diameter of several micrometers. The vibration of the vibrating electrode plate and the like are hardly inspected through such small acoustic perforations.

On the other hand, when the opening diameter of the acoustic perforations is sufficiently increased or when the acoustic perforations are arranged with high density, it is believed that the vibrating electrode plate can be observed. However, when the acoustic perforations having a large opening diameter are provided almost in the whole of the counter electrode plate or when the acoustic perforations are opened almost in the whole of the counter electrode plate with high density, the substantial electrode area of the counter electrode plate is reduced and rigidity of the counter electrode plate is decreased to reduce the sensitivity of the acoustic sensor.

Therefore, there has been conventionally provided no acoustic sensor that can measure the gap or the characteristic of the vibrating electrode plate without too much degradation of the sensor sensitivity.

Japanese Unexamined Patent Publication No. 2004-128957 (Patent Document 3) discloses an acoustic sensor in which, in an outer circumferential portion of the counter electrode plate, the opening diameter of the acoustic perforations is made larger than that of the acoustic perforations located in the central portion and arrangement density of the acoustic perforations is made higher than that of the central portion. However, in Patent Document 3, the reason why the acoustic perforations are made large is that a parasitic capacitance is decreased between the vibrating electrode plate and the counter electrode plate.

Because the center of the movable portion of the vibrating electrode plate vibrates most largely, it is necessary to observe the central portion of the vibrating electrode plate in order to measure the vibration characteristic of the vibrating electrode plate. On the other hand, in the acoustic sensor of Patent Document 3, only an outer circumferential edge (near the fixing portion) of the vibrating electrode plate can be observed through the acoustic perforations having the large opening diameter, and the vibration characteristic of the vibrating electrode plate cannot efficiently be observed.

(Sticking of Vibrating Electrode Plate)

In the case of a capacitance type acoustic sensor, as illustrated in FIG. 2, the vibrating electrode plate 12 is sometimes firmly fixed to the counter electrode plate 13 during production or use thereof (hereinafter, a state or a phenomenon, in which part or substantially whole of the vibrating electrode plate is firmly fixed to the counter electrode plate to eliminate the gap, is referred to as sticking). When the vibrating electrode plate 12 sticks to the counter electrode plate 13, the acoustic sensor 11 cannot detect any acoustic vibration because the vibration of the vibrating electrode plate 12 is obstructed.

FIGS. 3(*a*) and 3(*b*) are schematic diagrams illustrating a cause of generation of the sticking in the acoustic sensor 11, and are enlarged views of a portion corresponding to the portion X of FIG. 2. Because the acoustic sensor 11 is produced by utilizing the micromachining technique, for example, water w invades between the vibrating electrode plate 12 and the counter electrode plate 13 in a cleaning process after etching. Even in use of the acoustic sensor 11, there are cases where moisture remains between the vibrating electrode plate 12 and the counter electrode plate 13 or the acoustic sensor 11 gets wet.

On the other hand, because the acoustic sensor 11 is a micro structure, the gap of only several micrometers exists between the vibrating electrode plate 12 and the counter electrode plate 13. Further, in order to enhance the sensitivity of the acoustic sensor 11, the vibrating electrode plate 12 has a thin film thickness of about 1 and thus a spring property of the vibrating electrode plate 12 is considerably weakened.

Therefore, in the acoustic sensor 11, the sticking is sometimes generated through a two-stage process as described below. In the first stage, as illustrated in FIG. 3(*a*), when the water w invades between the vibrating electrode plate 12 and the counter electrode plate 13, the counter electrode plate 13 attracts the vibrating electrode plate 12 due to a capillary force P1 or a surface tension of the water w.

In the second stage, after evaporation of the water w between the vibrating electrode plate 12 and the counter electrode plate 13, the vibrating electrode plate 12 sticks to the counter electrode plate 13 as illustrated in FIG. 3(*b*), and this state is maintained. An intermolecular force, an intersurface force, and an electrostatic force, which act between a surface of the vibrating electrode plate 12 and a surface of the counter electrode plate 13, can be cited as examples of a force P2 that firmly fixes the vibrating electrode plate 12 to counter electrode plate 13 to retain the vibrating electrode plate 12 even after the water w evaporates. As a result, the vibrating electrode plate 12 is retained while sticking to the counter electrode plate 13, thereby disabling the acoustic sensor 11.

(Problem with Air Damping)

In the conventional acoustic sensor, because of the small acoustic perforations, the air in the micro gap between the vibrating electrode plate and the counter electrode plate cannot smoothly flow into and out of the acoustic perforations when the vibrating electrode plate vibrates. Therefore, the vibration of the vibrating electrode plate is damped (air damping) by the air in the micro gap, which causes degradation of the sensitivity of the acoustic sensor.

In view of the foregoing problems, an object of the invention to provide an acoustic sensor that can measure a vibration characteristic and the like of the vibrating electrode plate from the counter electrode plate side without too much degradation of the sensor sensitivity.

Means for Solving the Problems

In order to achieve the above object, an acoustic sensor according to the invention includes: a substrate; a counter electrode plate that is fixed on the substrate and is provided with a plurality of acoustic perforations; a vibrating electrode plate that is provided between the substrate and the counter electrode plate with an air gap being provided from the counter electrode plate, the vibrating electrode plate sensing a sound pressure, wherein the acoustic perforations include a plurality of first acoustic perforations and a second acoustic perforation having an opening area larger than that of the first acoustic perforations, and the second acoustic perforation in the counter electrode plate is disposed in a region facing a central portion of a movable portion of the vibrating electrode plate.

In the acoustic sensor according to the invention, the second acoustic perforation having the large opening area is provided in the region facing the central portion of the movable portion of the vibrating electrode plate, so that the gap between the vibrating electrode plate and the counter electrode plate and the vibration characteristic of the vibrating electrode plate can be measured through the second acoustic perforation in the counter electrode plate. Further, because the central portion of the vibrating electrode plate can be measured through the second acoustic perforation, the vibration characteristic of the vibrating electrode plate can accurately be measured.

In this acoustic sensor, the acoustic perforation (second acoustic perforation) having the opening area larger than that of the other acoustic perforations (first acoustic perforations) is provided in the counter electrode plate. Therefore, the second acoustic perforation can be used as a marker for image recognition, and the accuracy of image recognition is enhanced.

In this acoustic sensor, the second acoustic perforation having the relatively large opening area is provided in the counter electrode plate, so that the water can rapidly be evaporated through the second acoustic perforation even if the water invades between the vibrating electrode plate and the counter electrode plate. Because the electrode area of the counter electrode plate can be reduced by opening the second acoustic perforation, decreased is the electrostatic force between the vibrating electrode plate to which a voltage is applied and the counter electrode plate. Therefore, the capillary force between the vibrating electrode plate and the counter electrode plate is decreased so as to reduce the sticking of the vibrating electrode film.

In the acoustic sensor according to an aspect of the invention, assuming that L is a width of the movable portion of the vibrating electrode plate, the second acoustic perforation in the counter electrode plate is provided within a circular region having a radius L/4 around a position facing a center of the movable portion. In the vibrating electrode plate, the deflection and the vibration are decreased outside the circular region of the radius L/4 from the center of the vibrating electrode plate, and the vibrating electrode film is hardly inspected with high accuracy outside the circular region. The second acoustic perforation in the counter electrode plate is provided inside the circular region of the radius L/4 from the point facing the center of the vibrating electrode plate. Therefore, in the vibrating electrode plate, the site in which the deflection or the vibration is increased can be measured through the second acoustic perforation.

In the acoustic sensor according to a different aspect of the invention, only one second acoustic perforation configured identically is provided. In this aspect, the number of the second acoustic perforations having the large opening area is set to the minimum, so that reduction in electrode area of the counter electrode plate can be minimized to lessen deterioration in sensitivity of the acoustic sensor.

In this aspect, in a case where the second acoustic perforation in the counter electrode plate is provided in the position facing the center of the movable portion of the vibrating electrode plate, the center of the largest vibration or deflection of the vibrating electrode plate can be measured through the second electrode perforation to enhance the measurement accuracy.

In the acoustic sensor according to another different aspect of the invention, the plurality of second acoustic perforations are provided. In this aspect, the plural second acoustic perforations having the large opening area are provided in the counter electrode plate, so that the water invading between the vibrating electrode plate and the counter electrode plate can be evaporated more rapidly through the second acoustic perforations. Further, the electrode area of the counter electrode plate can be further reduced to decrease the electrostatic force between the vibrating electrode plate and the counter electrode plate. Therefore, in this embodiment, the sticking of the vibrating electrode plate can be reduced more effectively.

In the acoustic sensor according to still another different aspect of the invention, the first acoustic perforations in the counter electrode plate are disposed more densely in a region facing a central portion of the movable portion of the vibrating electrode plate rather than in a region outside the region. In this aspect, the first acoustic perforations are disposed more densely in the region facing the central portion of the movable portion of the vibrating electrode plate rather than in a region outside the region, so that the water invading between the vibrating electrode plate and the counter electrode plate can more rapidly be evaporated through the densely disposed first acoustic perforations. Further, the electrode area of the counter electrode plate can be further reduced to decrease the electrostatic force between the vibrating electrode plate and the counter electrode plate. Therefore, in this embodiment, the sticking of the vibrating electrode plate can be reduced more effectively.

In the invention, the means for solving the problems has the features obtained by appropriately combining the constituents described above, and various variations can be made in the invention by the combinations of the constituents.

DESCRIPTION OF SYMBOLS

Figure 1:
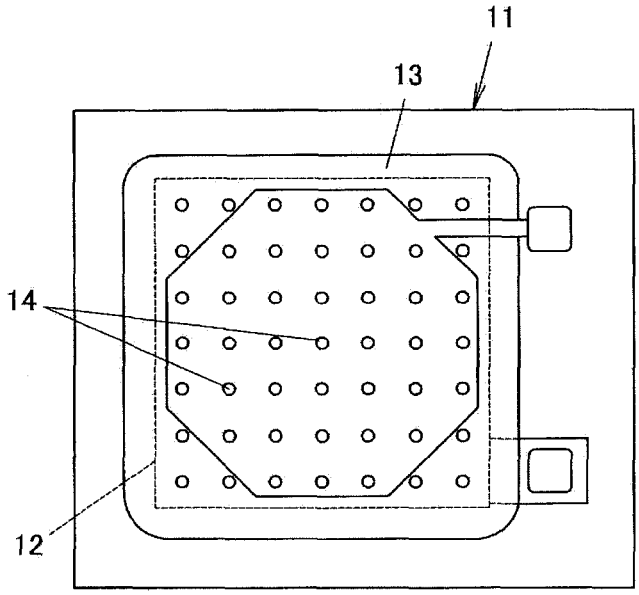
FIG. 1 is a plan view schematically illustrating a structure of a conventional acoustic sensor.
Figure 2:
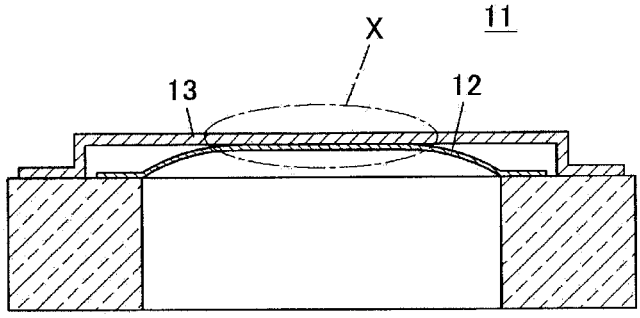
FIG. 2 is a schematic sectional view illustrating a state in which a vibrating electrode plate sticks to a counter electrode plate in the conventional acoustic sensor.
Figure 3A:
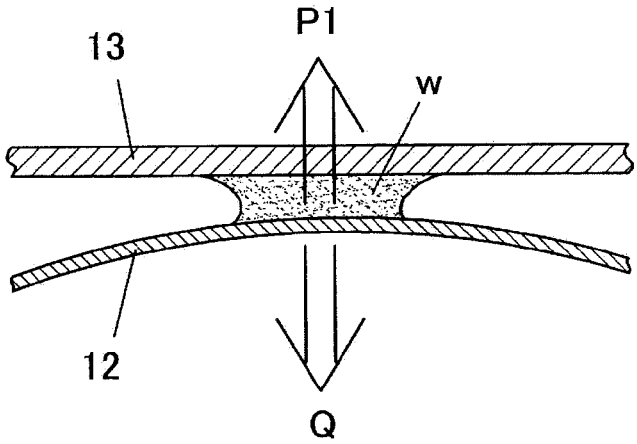
FIGS. 3(*a*) and 3(*b*) are views illustrating a cause of generation of sticking in the conventional acoustic sensor.
Figure 3B:
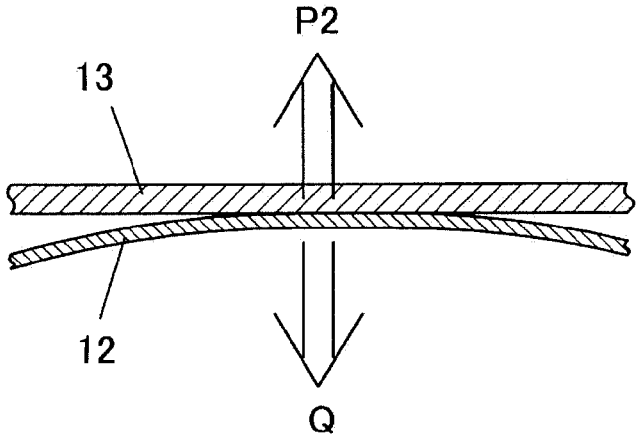

21 acoustic sensor
22 silicon substrate
24 vibrating electrode plate
25 counter electrode plate
28 diaphragm
30 fixed electrode
31 acoustic perforation
36 acoustic perforation
41 acoustic sensor
51 acoustic sensor
w water

BEST MODE FOR CARRYING OUT THE INVENTION

Preferred embodiments of the invention will be described below with reference to the accompanying drawings. However, the invention is not limited to the following embodiments unless departing from the concept of the invention.

First Embodiment

Figure 4:
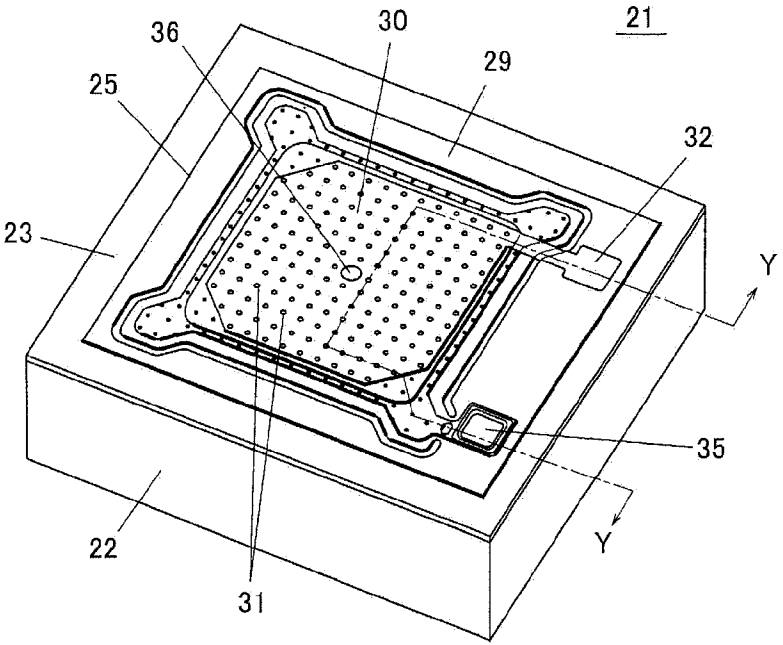
FIG. 4 is a perspective view illustrating an acoustic sensor according to a first embodiment of the invention.
Figure 5:
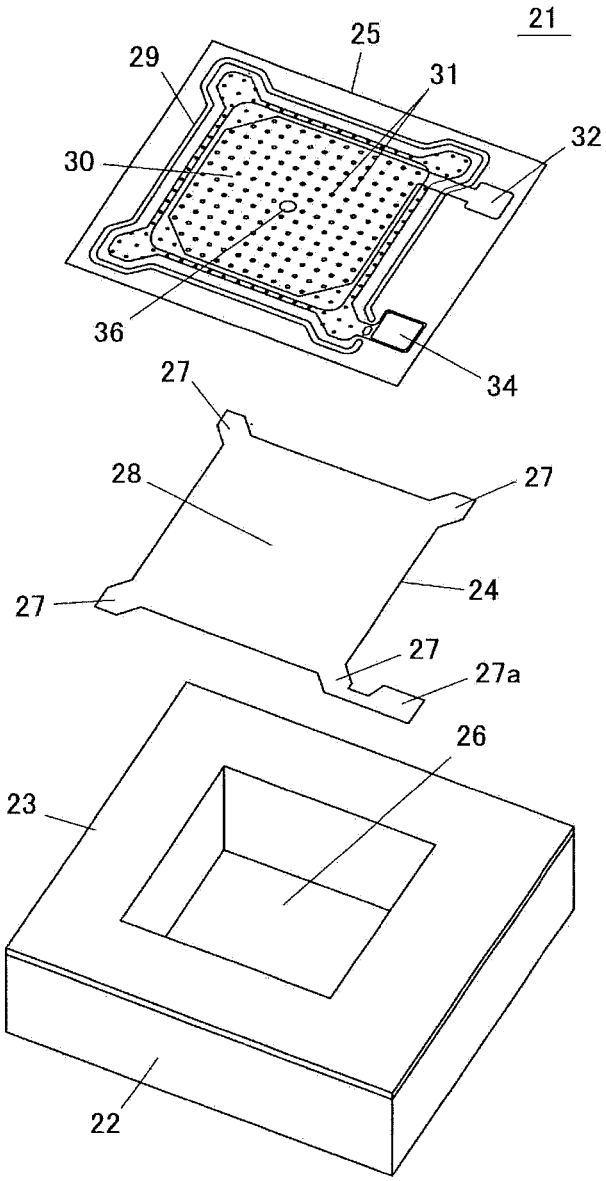
FIG. 5 is an exploded perspective view of the acoustic sensor according to the first embodiment.
Figure 6:
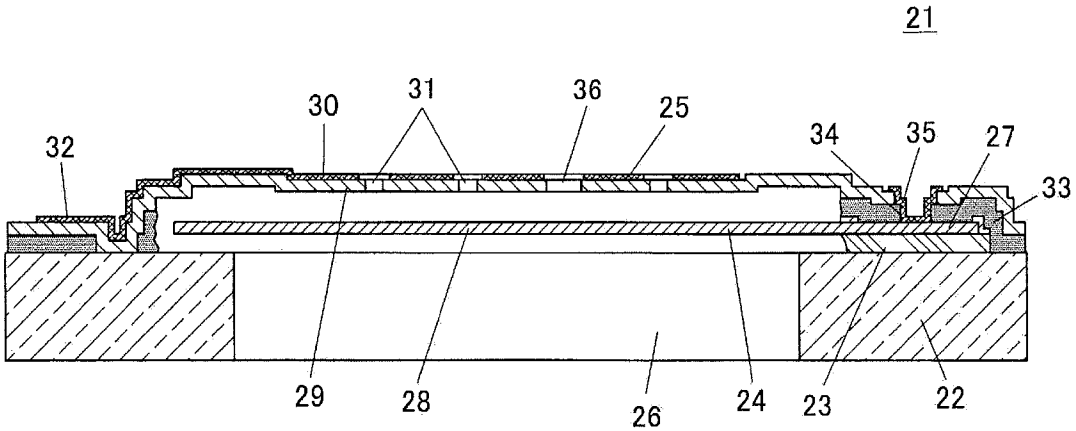
FIG. 6 is a sectional view taken on a line Y-Y of FIG. 4.

A first embodiment of the invention will be described with reference to FIGS. 4 to 9. FIG. 4 is a perspective view illustrating an acoustic sensor 21 according to the first embodiment, FIG. 5 is an exploded perspective view thereof, and FIG. 6 is a sectional view taken on a line Y-Y of FIG. 4.

The acoustic sensor 21 is of a capacitance type. In the acoustic sensor 21, a vibrating electrode plate 24 is provided on an upper surface of a silicon substrate 22 with an insulating coating 23 interposed therebetween, and a counter electrode plate 25 is provided on the vibrating electrode plate 24 with a micro gap (air gap) interposed therebetween.

A prismatic through-hole 26 or a truncated-pyramid recess is provided in the silicon substrate 22. The prismatic through-hole 26 is illustrated in the drawing. The silicon substrate 22 has a size of 1 to 1.5 mm square (can be formed smaller than this size) in a planar view, and the silicon substrate 22 has a thickness of about 400 to 500 μm. The insulating coating 23 made of an oxide film is formed on the upper surface of the silicon substrate 22.

The vibrating electrode plate 24 is made of a polysilicon thin film having a thickness of about 1 μm. The vibrating electrode plate 24 is a thin film formed into a substantially rectangular shape, and fixing portions 27 are extended outward in diagonal directions in four corners of the vibrating electrode plate 24. The vibrating electrode plate 24 is disposed on the upper surface of the silicon substrate 22 such that the upper opening of the through-hole 26 or the recess is covered therewith, and the fixing portions 27 are fixed onto the insulating coating 23. The portion (in this embodiment, portion except for the fixing portions 27) that is supported while floating above the through-hole 26 or the recess in the vibrating electrode plate 24 constitutes a diaphragm 28 (movable portion), which vibrates in response to a sound pressure.

In the counter electrode plate 25, a fixed electrode 30 made of a metallic thin film is provided on an upper surface of an insulating support layer 29 made of a nitride film. The counter electrode plate 25 is disposed on the vibrating electrode plate 24. Outside the region facing the diaphragm 28, the counter electrode plate 25 is fixed to the upper surface of the silicon substrate 22 while an insulating coating 33 made of an oxide film or the like is interposed therebetween. In the region facing the diaphragm 28, the diaphragm 28 is covered with the counter electrode plate 25 with a micro gap of about 3 μm interposed therebetween. In order to allow a sound pressure (vibration) to pass through, acoustic perforations (acoustic holes) are provided in the fixed electrode 30 and support layer 29, respectively, such as to pierce from the upper surface to the lower surface. The vibrating electrode plate 24 is made of a thin film having a thickness of about 1 μm because the vibrating electrode plate 24 vibrates by resonating with a sound pressure. However, because the counter electrode plate 25 is an electrode that is not excited by a sound pressure, the counter electrode plate 25 is made thick such as to have a thickness of 2 μm or more.

Figure 7:
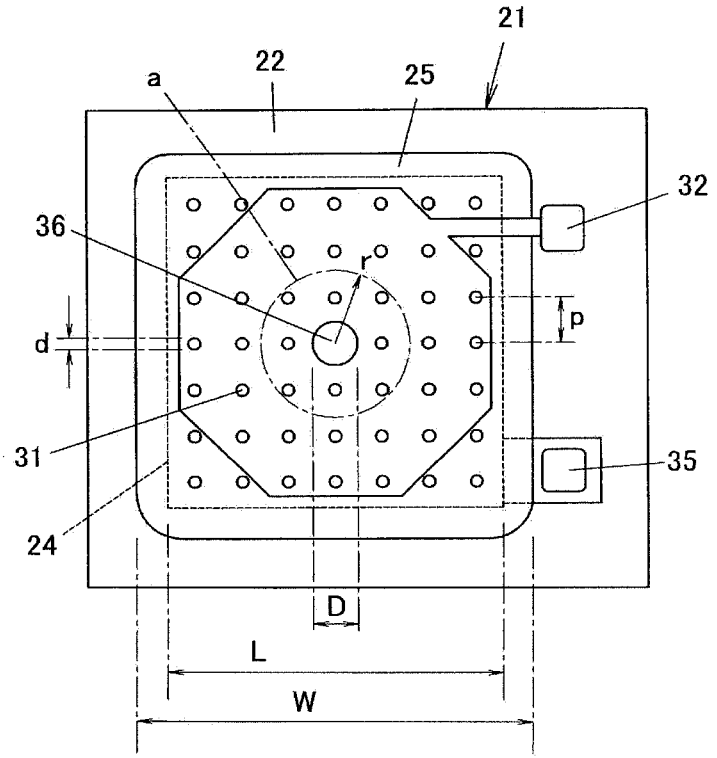
FIG. 7 is a plan view schematically illustrating the acoustic sensor according to the first embodiment.

FIG. 7 is a plan view schematically illustrating the acoustic sensor 21. The acoustic perforations opened in the counter electrode plate 25 include plural acoustic perforations 31 (first acoustic perforations) having a relatively small opening area and one acoustic perforation 36 (second acoustic perforation) having a relatively large opening area, and the acoustic perforations 31 and 36 are disposed into a lattice shape at equal intervals. Assuming that L is a width (although not illustrated, a diameter in a case of a circular diaphragm 28) of the diaphragm 28, in the counter electrode plate 25, the acoustic perforation 36 having the large opening area is located within a circular region a of a radius r=L/4 around a position facing the center of the diaphragm 28. Particularly preferably, in the counter electrode plate 25, the acoustic perforation 36 is provided in the position facing the center of the diaphragm 28. To be numerically specific, the diaphragm 28 has the width L of 800 μm, and the counter electrode plate 25 has a width W of 1000 μm. Each of the circular acoustic perforations 31 has a diameter d of 10 μm, the circular acoustic perforation 36 has a diameter D of 20 μm, and the acoustic perforations 31 and 36 are arranged at intervals p equal to 50 μm.

An electrode pad 32 electrically connected to the fixed electrode 30 is provided in an end portion of the counter electrode plate 25. An extended portion 27*a* extended from the fixing portion 27 is exposed from an opening 34 formed in the support layer 29, and an electrode pad 35 provided on the upper surface of the end portion of the support layer 29 is electrically connected to the extended portion 27*a* through the opening 34. Therefore, the vibrating electrode plate 24 and the counter electrode plate 25 are electrically insulated from each other, and the vibrating electrode plate 24 and the fixed electrode 30 constitute a capacitor.

In the acoustic sensor 21 according to the first embodiment, when acoustic vibration (compressional wave of air) reaches the surface thereof, the acoustic vibration reaches the diaphragm 28 through the acoustic perforations 31 in the counter electrode plate 25, thereby vibrating the diaphragm 28. When the diaphragm 28 vibrates, the gap between the diaphragm 28 and the counter electrode plate 25 is changed, thereby varying an electrostatic capacitance between the diaphragm 28 and the fixed electrode 30. Therefore, in a case where the change in electrostatic capacitance is taken out as an electric signal while a direct-current voltage is applied between the electrode pads 32 and 35, the acoustic vibration can be detected by converting the acoustic vibration into the electric signal.

In the acoustic sensor 21, as illustrated in FIG. 7, because the acoustic perforation 36 larger than the other acoustic perforations 31 is located in the central portion of the acoustic sensor 21, good image recognition performance is obtained to improve alignment accuracy. For example, the acoustic sensor 21 is a several-micrometer-square micro structure that is produced by the micromachining (semiconductor microfabrication) technique. Therefore, when the acoustic sensor 21 is mounted on a circuit board or the like, the image of the acoustic sensor 21 is taken with an imaging camera to recognize the image, so that the acoustic sensor 21 is automatically amounted using a chip mounter or the like. In this case, because the acoustic perforation 36 in the central portion differs in size from the other acoustic perforations 31, the acoustic perforation 36 serves as a clear marker for the image recognition, the recognition performance of the image taken with the imaging camera is improved, and therefore the acoustic sensor 21 can accurately be picked up using the chip mounter.

Figure 8:
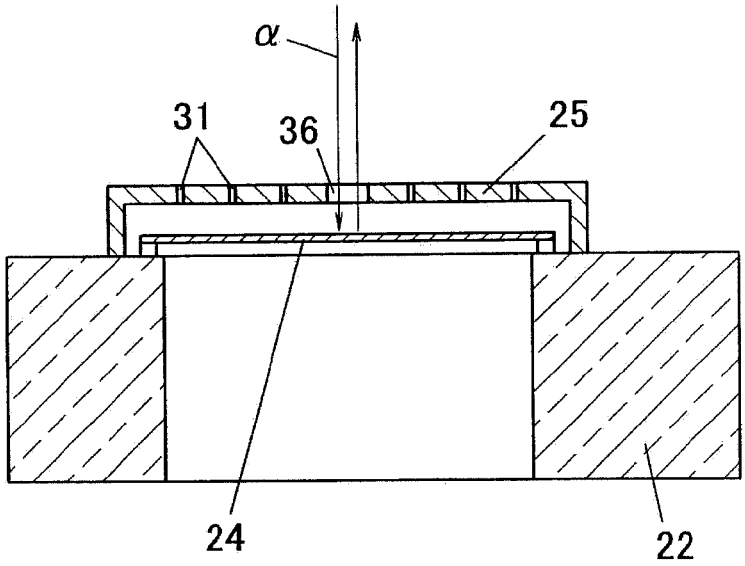
FIG. 8 is a schematic sectional view illustrating a state in which the acoustic sensor according to the first embodiment is inspected.

In the inspection process after production of the acoustic sensor 21, various inspections and measurements on the vibrating electrode plate 24 can be performed by utilizing the acoustic perforation 36. For example, as illustrated in FIG. 8, the vibrating electrode plate 24 is irradiated with a laser beam a passing through the acoustic perforation 36, and the laser beam a reflected by the vibrating electrode plate 24 is received. Then, an oscillation quantity, an eigenfrequency, and the like can be measured with a laser Doppler measuring instrument. In performing the inspections with use of a laser beam, the acoustic perforation 36 desirably has the diameter D of 10 μm or more. When the acoustic perforation 36 has the diameter D less than 10 μm, even if the vibrating electrode plate 24 is irradiated with the laser beam a passing through the acoustic perforation 36, the reflected laser beam a is difficult to return because the reflected laser beam a strikes on the edge of the acoustic perforation 36.

The gap between the counter electrode plate 25 and the vibrating electrode plate 24 can be measured through the acoustic perforation 36 using an optical three-dimensional measuring instrument or a length-measuring machine. In the acoustic sensor 21, the gap between the vibrating electrode plate 24 and the counter electrode plate 25 is an important factor in view of the characteristic thereof. A gap anomaly caused by the initial deflection of the vibrating electrode plate 24 or the counter electrode plate 25 can be sensed by using one of these measuring instruments. In order to perform the inspections using such a measuring instrument, the acoustic perforation 36 desirably has the diameter D of 20 μm or more.

In the vibrating electrode plate 24, the deflection or the vibration is small outside the circular region a of the radius L/4 from the center of the diaphragm 28, and the inspection accuracy degrades outside the circular region a. Accordingly, in order to perform the inspections described above, the acoustic perforation 36 is desirably provided inside the circular region a of the radius r=L/4 around the point facing the center of the diaphragm 28. Particularly, in the vibrating electrode plate 24, the oscillation quantity often becomes the maximum in the central portion of the diaphragm 28. Therefore, when the vibrating electrode plate 24 is measured, the acoustic perforation 36 is desirably provided in the position facing the center of the diaphragm 28.

Figure 9A:
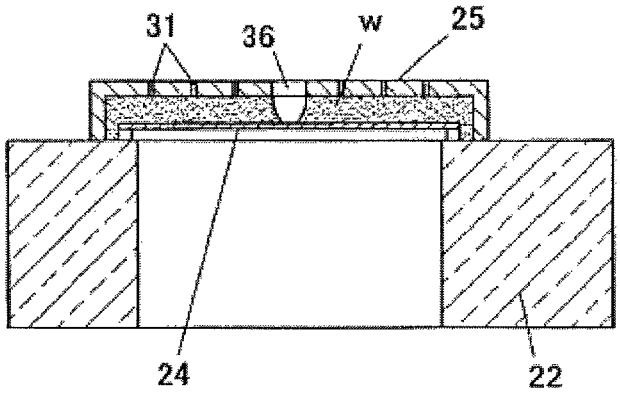
FIGS. 9(*a*) and 9(*b*) are views illustrating a reason why the sticking of the vibrating electrode plate can be reduced in the acoustic sensor according to the first embodiment.
Figure 9B:
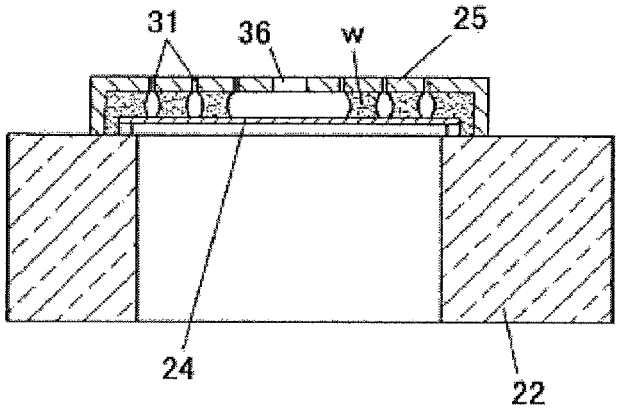

In this acoustic sensor 21, the sticking of the vibrating electrode plate 24 can be reduced. For example, even if the micro gap between the vibrating electrode plate 24 and the counter electrode plate 25 is filled with the water w due to washing in the production process of the acoustic sensor 21, as illustrated in FIG. 9(*a*), drying starts quicker in the acoustic perforation 36 having the large opening diameter rather than in the other acoustic perforations 31 in the subsequent drying process. As illustrated in FIG. 9(*b*), the water w disappears in the acoustic perforation 36 in the course of the drying process time, and drying of the water w also advances also in the other acoustic perforations 31. Because the water evaporates rapidly in the central portion of the diaphragm 28, where the sticking is generated most easily, the capillary force is weakened in the central portion of the diaphragm 28 to reduce the sticking of the vibrating electrode plate 24.

Second Embodiment

Figure 10:
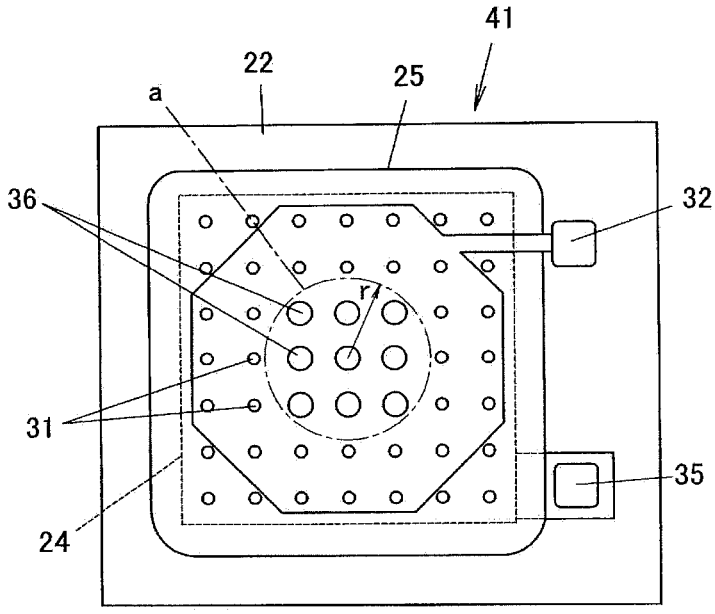
FIG. 10 is a plan view schematically illustrating an acoustic sensor according to a second embodiment of the invention.

FIG. 10 is a plan view schematically illustrating an acoustic sensor 41 according to a second embodiment of the invention. In the acoustic sensor 41, the plural acoustic perforations 36 are provided in the counter electrode plate 25. The acoustic perforations 36 are provided at intervals equal to those of the acoustic perforations 31, and the acoustic perforations 36 and 31 are evenly arranged. This is because etching is equally performed in opening the acoustic perforations 31 and 36.

Also in this acoustic sensor 41, as in the case of the first embodiment, the plural acoustic perforations 36 serve as the markers for image recognition, so as to perform the image recognition of the acoustic sensor 41 with high accuracy. The vibrating electrode plate 24 can be measured through the acoustic perforations 36 using the laser Doppler measuring instrument, the optical three-dimensional measuring instrument, the length-measuring machine, or the like. Particularly, because the plural acoustic perforations 36 are opened, the vibration state and the like of the vibrating electrode plate 24 can be measured in a wider range. Further, also in the case of the acoustic sensor 41, for the reason similar to that of the first embodiment, each of the acoustic perforations 36 is desirably provided inside the circular region a of the radius r=L/4 around the point facing the center of the diaphragm 28. The radius r=L/4 of the circular region a is equal to 200 μm when the width L of the diaphragm 28 is set to 800 μm.

Figure 11:
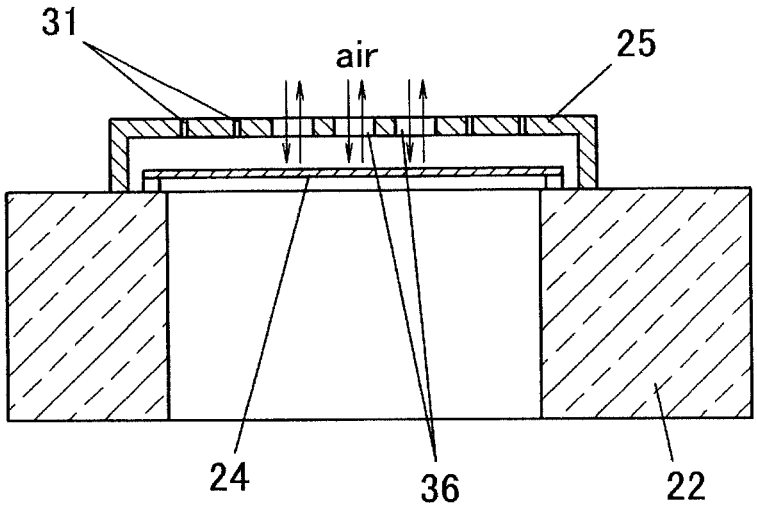
FIG. 11 is a view illustrating a reason why air damping of the vibrating electrode plate can be reduced in the acoustic sensor according to the second embodiment.

In this acoustic sensor 41, because the opening area of the counter electrode plate 25 is larger than that of the first embodiment, air easily passes through the counter electrode plate 25 as illustrated in FIG. 11. When the vibrating electrode plate 24 vibrates, the air between the vibrating electrode plate 24 and the counter electrode plate 25 easily flows in and out through the acoustic perforations 36 and 31. Therefore, air damping is hardly generated, the frequency characteristic (particularly, characteristic in a high frequency) of the acoustic sensor 41 is flattened, and the frequency characteristic is improved. The air damping is a phenomenon in which the air between the vibrating electrode plate 24 and the counter electrode plate 25 suppresses vibration of the vibrating electrode plate 24.

Figure 12:
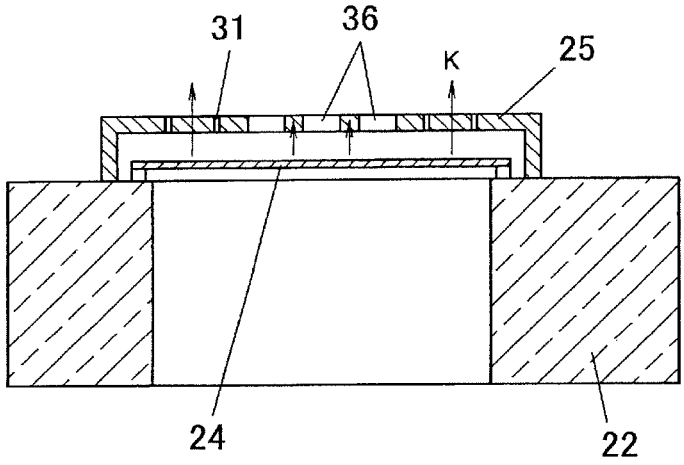
FIG. 12 is a view illustrating a reason why a pull-in voltage can be reduced in the acoustic sensor according to the second embodiment.

In this acoustic sensor 41, because the plural acoustic perforations 36 are opened in the counter electrode plate 25 to increase the opening area of the counter electrode plate 25, the sticking of the vibrating electrode plate 24 is reduced as in the first embodiment (see FIG. 9). Specifically, even if the acoustic sensor 41 gets wet during washing in the production process of the acoustic sensor 41, because the water remaining between the vibrating electrode plate 24 and the counter electrode plate 25 evaporates rapidly through the acoustic perforations 36, the central portion of the diaphragm 28 evaporates rapidly to decrease the capillary force, thereby reducing the sticking of the vibrating electrode plate 24. Further, in this acoustic sensor 41, the plural acoustic perforations 36 are provided so as to face the central portion of the diaphragm 28, so that the electrode area of the counter electrode plate 25 can be reduced in the central portion of the vibrating electrode plate 24, where large displacement (deflection) is generated, as illustrated in FIG. 12. As a result, an electrostatic attractive force K acting between the counter electrode plate 25 and the central portion of the diaphragm 28 is decreased, and the sticking can further be reduced while the pull-in voltage is lowered.

Third Embodiment

Figure 13:
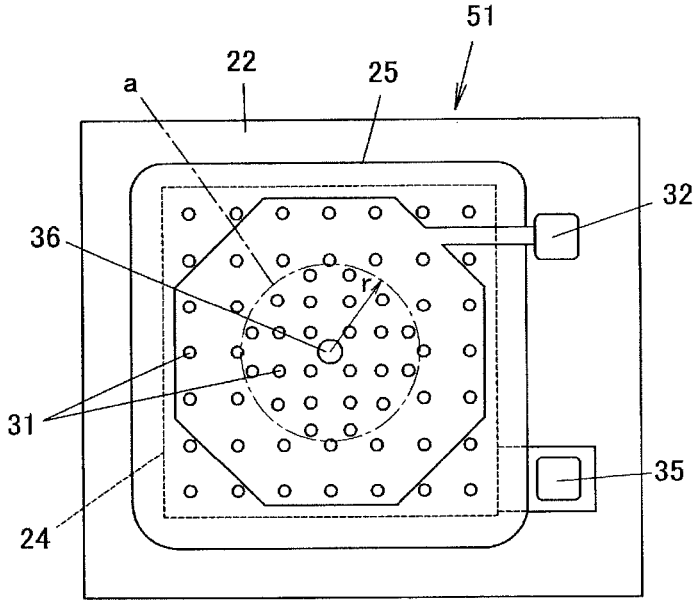
FIG. 13 is a plan view illustrating an acoustic sensor 51 according to a third embodiment of the invention.

FIG. 13 is a plan view schematically illustrating an acoustic sensor 51 according to a third embodiment of the invention. In the acoustic sensor 51, the acoustic perforation 36 having a large opening diameter in the counter electrode plate 25 is provided in the position facing the center of the diaphragm 28. In the counter electrode plate 25, the acoustic perforations 31 are densely provided within the circular region a around the point facing the center of the diaphragm 28. The acoustic perforations 31 located within the circular region a have the same opening diameter as that of the acoustic perforations 31 located outside the circular region a, and the interval between the acoustic perforations 31 located within the circular region a is smaller than the interval between the acoustic perforations 31 located outside the circular region a. For a reason similar to that of the first embodiment, the radius r of the circular region a is desirably set to r=L/4. For example, in a case where the interval between the acoustic perforations 31 is set to 50 μm outside the circular region a as in the first embodiment, the interval between the acoustic perforations 31 is set to 25 μm within the circular region a.

Also in this acoustic sensor 51, as in the first embodiment, the acoustic perforation 36 serves as the marker for image recognition, and the acoustic sensor 51 performs the image recognition with high accuracy. The vibrating electrode plate 24 can be measured through the acoustic perforation 36 using the laser Doppler measuring instrument, the optical three-dimensional measuring instrument, the length-measuring machine, or the like.

In the acoustic sensor 51, as in the second embodiment, because the opening area of the counter electrode plate 25 is increased, air easily passes through the counter electrode plate 25. Therefore, vibration of the vibrating electrode plate 24 is hardly damped by air, the frequency characteristic (particularly, the characteristic in the high frequency) of the acoustic sensor 51 is flattened, and the frequency characteristic is improved.

In this acoustic sensor 51, the acoustic perforation 36 having the large opening diameter and the densely-arranged acoustic perforations 31 are provided in the region facing the central portion of the diaphragm 28 of the counter electrode plate 25 in order to increase the opening area of the counter electrode plate 25. Therefore, the sticking of the vibrating electrode plate 24 is reduced as in the first embodiment (see FIG. 9). More specifically, even if the acoustic sensor 51 gets wet during washing in the production process of the acoustic sensor 51, because the water remaining between the vibrating electrode plate 24 and the counter electrode plate 25 evaporates rapidly through the acoustic perforation 36 and the acoustic perforations 31 in the central portion, the central portion of the diaphragm 28 evaporates rapidly to decrease the capillary force, thereby reducing the sticking of the vibrating electrode plate 24. Further, also in the acoustic sensor 51, the acoustic perforation 36 and the densely-arranged acoustic perforations 31 are provided to face the central portion of the diaphragm 28, so that the electrode area of the counter electrode plate 25 can be reduced in the central portion, where large displacement (deflection) of the vibrating electrode plate 24 is generated. As a result, the electrostatic attractive force acting between the counter electrode plate 25 and the central portion of the diaphragm 28 is decreased, and the sticking can further be reduced while the pull-in voltage is lowered.

The invention claimed is:

1. An acoustic sensor comprising:

a substrate;

a counter electrode plate that is fixed on the substrate and is provided with a plurality of acoustic perforations;

a vibrating electrode plate that is provided between the substrate and the counter electrode plate with an air gap being provided from the counter electrode plate, the vibrating electrode plate sensing a sound pressure, wherein the acoustic perforations include a plurality of first acoustic perforations and a second acoustic perforation having an opening area larger than that of the first acoustic perforations, and the second acoustic perforation in the counter electrode plate is disposed in a region facing a central portion of a movable portion of the vibrating electrode plate.

2. The acoustic sensor according to claim 1, wherein, assuming that L is a width of the movable portion of the vibrating electrode plate, the second acoustic perforation in the counter electrode plate is provided within a circular region having a radius L/4 around a position facing a center of the movable portion.

3. The acoustic sensor according to claim 1, wherein only one second acoustic perforation configured identically is provided.

4. The acoustic sensor according to claim 3, wherein the second acoustic perforation in the counter electrode plate is provided in a position facing a center of the movable portion of the vibrating electrode plate.

5. The acoustic sensor according to claim 1, wherein the plurality of second acoustic perforations are provided.

6. The acoustic sensor according to claim 1, wherein the first acoustic perforations in the counter electrode plate are disposed more densely in a region facing a central portion of the movable portion of the vibrating electrode plate rather than in a region outside the region.

* * * * *